US007210392B2

(12) United States Patent
Greene et al.

(10) Patent No.: US 7,210,392 B2
(45) Date of Patent: May 1, 2007

(54) AUTONOMOUS WEAPON SYSTEM

(75) Inventors: Ben A. Greene, Isaacs (AU); Steven Greene, Isaacs (AU)

(73) Assignee: Electro Optic Systems Pty Limited, Queanbeyan (AU)

( * ) Notice: Subject to any disclaimer, the term of this patent is extended or adjusted under 35 U.S.C. 154(b) by 29 days.

(21) Appl. No.: 10/399,110

(22) PCT Filed: Oct. 17, 2001

(86) PCT No.: PCT/AU01/01344

§ 371 (c)(1),
(2), (4) Date: Sep. 25, 2003

(87) PCT Pub. No.: WO02/33342

PCT Pub. Date: Apr. 25, 2002

(65) Prior Publication Data

US 2004/0050240 A1 Mar. 18, 2004

(30) Foreign Application Priority Data

Oct. 17, 2000 (AU) ..... PR0804

(51) Int. Cl.
*F41G 3/00* (2006.01)

(52) U.S. Cl. ..... 89/41.03; 89/41.22

(58) Field of Classification Search ..... 89/41.01, 89/41.03, 41.05, 41.07, 41.17, 41.02, 41.22, 89/1.11, 41.06
See application file for complete search history.

(56) References Cited

U.S. PATENT DOCUMENTS 3,793,481 A * 2/1974 Ripley et al. ..... 348/139
3,974,740 A 8/1976 Billottet et al. ..... 89/41.07
4,004,487 A * 1/1977 Eichweber ..... 89/1.815
4,196,380 A * 4/1980 Gustavsson et al. ..... 318/630

(Continued)

FOREIGN PATENT DOCUMENTS

AU B-22814/92 11/1992

(Continued)

OTHER PUBLICATIONS

United States Navy—Fact File, Phalanx Close-In Weapons System, Naval Systems Command (OOD), Washington,DC, Sep. 13, 1999.*

(Continued)

*Primary Examiner*—Stephen M. Johnson
(74) *Attorney, Agent, or Firm*—Crowell & Moring LLP

(57) ABSTRACT

An autonomous weapon system including weapon (9) and weapon mounting system (7, 8) operable to point the weapon (9) in accordance with input control signals. The weapon system includes a sensor (2) to acquire images and other data from a target zone and an image processor (3) to process acquired image data and identify potential targets (1) according to predetermined target identification criteria. Targeting system (4, 5) provides input control signals to the weapon mounting system (7, 8) to point the weapon (9) for firing at potential targets (1). A control system operates targeting system (4, 5) and fires the weapon (9) at selected targets (1) according to a predetermined of rules of engagement. The rules of engagement include combat, peacekeeping or policing scenarios. Remotely located operator (10) may amend the rules of engagement, or override the control system as required.

18 Claims, 4 Drawing Sheets

U.S. PATENT DOCUMENTS

| | | | | | |
|---|---|---|---|---|---|
| 4,265,111 | A | * | 5/1981 | Teiling | 73/178 R |
| 4,266,463 | A | * | 5/1981 | Saltin | 89/41.22 |
| 4,267,562 | A | * | 5/1981 | Raimondi | 348/144 |
| 4,326,340 | A | * | 4/1982 | Blomqvist et al. | 89/204 |
| 4,480,524 | A | * | 11/1984 | Blomqvist et al. | 89/41.16 |
| 4,579,035 | A | * | 4/1986 | Whiting | 89/41.05 |
| 4,655,411 | A | * | 4/1987 | Franzen et al. | 244/3.11 |
| 4,677,469 | A | * | 6/1987 | Neubauer et al. | 382/218 |
| 4,760,397 | A | * | 7/1988 | Piccolruaz | 342/75 |
| 4,787,291 | A | * | 11/1988 | Frohock, Jr. | 89/41.22 |
| H613 | H | * | 4/1989 | Stello et al. | 434/19 |
| 5,007,736 | A | * | 4/1991 | Daniel et al. | 356/139.08 |
| 5,153,366 | A | * | 10/1992 | Lucas | 89/1.11 |
| 5,206,452 | A | * | 4/1993 | Stamper et al. | 89/1.11 |
| 5,378,155 | A | * | 1/1995 | Eldridge | 434/11 |
| 5,379,676 | A | * | 1/1995 | Profeta et al. | 89/41.05 |
| 5,471,213 | A | * | 11/1995 | Hergesheimer | 342/67 |
| 5,497,705 | A | * | 3/1996 | Bredy et al. | 102/427 |
| 5,605,307 | A | * | 2/1997 | Batchman et al. | 244/3.11 |
| 5,682,006 | A | | 10/1997 | Perry et al. | 89/41.01 |
| 5,686,690 | A | * | 11/1997 | Lougheed et al. | 89/41.17 |
| 5,949,015 | A | * | 9/1999 | Smith et al. | 89/41.05 |
| 5,992,288 | A | | 11/1999 | Barnes | 89/1.11 |
| 6,260,466 | B1 | * | 7/2001 | Humphreys | 89/41.06 |
| 6,447,009 | B1 | * | 9/2002 | McMillan | 280/757 |
| 6,450,442 | B1 | * | 9/2002 | Schneider et al. | 244/3.14 |
| 6,456,235 | B1 | * | 9/2002 | Utley et al. | 342/360 |
| 6,467,388 | B1 | * | 10/2002 | Malakatas | 89/41.03 |
| 6,487,953 | B1 | * | 12/2002 | McIngvale | 89/41.05 |
| 6,491,253 | B1 | * | 12/2002 | McIngvale | 244/3.11 |
| 6,497,169 | B1 | * | 12/2002 | Khosla | 89/1.11 |
| 6,672,534 | B2 | * | 1/2004 | Harding et al. | 244/3.15 |

FOREIGN PATENT DOCUMENTS

| | | | |
|---|---|---|---|
| DE | 39 12 672 | A1 | 10/1990 |
| DE | 197 52 464 | A1 | 7/1999 |
| WO | WO/88/02841 | * | 4/1988 |

OTHER PUBLICATIONS

PCT International Search Report dated Nov. 12, 2001.

* cited by examiner

AUTONOMOUS WEAPON SYSTEM

FIELD OF THE INVENTION

This invention relates generally to autonomous direct fire weapon systems, being weapon systems that engage targets with no requirement for human intervention or support at the time of engagement, and with direct fire, meaning that a line-of-sight exists between the weapon and the target.

BACKGROUND ART

Direct fire weapons are weapons that require a line-of-sight between the weapon and the target. Examples of direct fire weapons include rifles, machine guns, canon, short range missiles and directed energy weapons. Examples of indirect fire weapons include artillery, mortars, and long-range missiles.

Until the middle of the $20^{th}$ century, direct fire weapons were fired manually by a gunner positioned directly behind the weapon. The advantages of remote operation (e.g. of machine guns during trench warfare) were observed in the early $20^{th}$ century, but the technology did not exist to allow remote operation without substantially degrading overall combat effectiveness.

By 1980 it was widespread practice to include as secondary armament on a main battle tank, small arms with either remote control or armour cover, or both. Small arms, generally defined as ballistic weapons with a calibre of less than 40 mm, are direct fire weapons.

By 1990 the increased emphasis on maximizing both mobility and firepower resulted in various proposals for remotely operated weapon stations, in which small arms are mounted on motorized brackets and remotely operated. Typically these systems comprise a machine gun roof-mounted on a lightly armored or unarmored vehicle, and operated under manual control from within the vehicle.

These systems offer several advantages, including:

- the use of a remote gunner lowers the center of mass of the weapon system, allowing heavier weapons to be mounted on lighter vehicles without compromising stability;
- the relocation of the gunner obviates the need for a turret, allowing weight savings that lead to increased mobility;
- protection of the gunner improves weapon aiming and combat effectiveness;
- the relocation of the gunner hardens the weapon system as a target, making it more difficult to disable than a manned weapon; and
- vehicle hull penetration by the weapon system can be reduced to small mounting holes, thus increasing the survivability of the vehicle. The large hole required for a human operator is not required.

More recently, gyro-stabilized remotely-controlled weapon systems have been proposed (Smith et al, U.S. Pat. No. 5,949,015 dated Sep. 7, 1999). These gyro-stabilized remote weapon control systems have the additional advantage that the aiming point of the weapon may be rendered substantially independent of motion of the weapon platform.

Notwithstanding the advantages of remote weapon systems, their shortcomings include:

- Poor accuracy. The use of manual weapon pointing, even if stabilized for weapon platform motion, does not allow optimum use of weapons. The most common and inexpensive direct-fire weapons have inherent accuracy that exceeds the ability of human gunners to aim the weapon.

- Poor ergonomics. Typical implementations of remote weapon systems require int nse multi-tasking of the remot gunner under combat stress, particularly if the weapon is vehicle-mounted. This reduces the effectiveness of the weapon system.
- Poor stabilization. Gyro-stablized weapon systems seek to maintain weapon aiming accuracy by compensating for the motion of the weapon platform. For each axis of potential motion of the weapon, gyro is required, as well as a corresponding servo-controlled axis on the weapon mount. This results in costly systems that do not take into account movement of the target, and are of limited use in realistic combat situations involving target motion.

DISCLOSURE OF THE INVENTION

The invention is an autonomous weapon system, being a weapon system that can engage targets with no human intervention at the time of engagement.

In one broad aspect this invention provides an autonomous weapon system including a weapon to be fired at a target; a weapon mounting system operable to point the weapon in accordance with input control signals; a sensor system to acquire images and other data from a target zone; image processing means to process said acquired images or data and identify potential targets according to predetermined target identification criteria; targeting means to provide said input control signals to said weapon mounting system to point the weapon for firing at a selected one or more of said potential targets; firing control means to operate said targeting means and fire the weapon at selected ones of said potential targets according to a predetermined set of rules of engagement.

Preferably, the autonomous weapon system ("AWS") further includes a communication means that allow authorized users of the system to update, upgrade, modify or amend the software and firmware controlling the operation of the system or monitor its operation. The communication means may provide for the overriding of the firing control means to prevent firing of the weapon. The communication means may also provide for amendment of the rules of engagement at any time during operation of the system. The communication means can preferably be used to update data files in the weapon system, including those files providing a threat profile to determine the predetermined target identification criteria used by the processing means to identify potential targets.

The sensor system preferably includes one or more cameras operating at the visible, intensified visible or infrared wavelengths and producing images in digital form, or compatible with digital processing. Preferably, the effective focal length of one or more camera can be varied by either optical or digital zoom to allow closer scrutiny of potential targets.

Preferably, the image processing means includes one or more digital signal processors or computers that provide image enhancement and target detection, recognition, or identification based on image characteristics. The image processing means may include pre-configured threat profiles to allow both conventional and fuzzy logic algorithms to efficiently seek targets according to the level of threat posed by specific targets, or the probability of encountering a specific target, or both.

The targeting means preferably provides the input control signals based on pointing corrections required for the weapon to hit the targets. The control signals can be provided in either digital or analogue form.

The firing control means preferably includes a fail-safe control of the firing of the weapon by reference to specific rules of engagement stored within the system. These specific rules of engagement include various combat, peace-keeping, or policing scenarios. The rules of engagement are preferably interpreted by the firing control means in context with the threat profile, to provide both lethal and non-lethal firing clearances without human intervention.

Preferably, an authorized user selects the set of rules of engagement to be used prior to deployment of the AWS. The authorized user may amend those rules at any time that communications are available with the AWS. The set of rules of engagement may preferably retainan enduring veto (exercisable by an authorized user) on the use of lethal force, or even the discharge of the weapon in warning mode. For example, one set of rules of engagement may prohibit the weapon from firing aimed lethal shots under any circumstances in a peace-keeping situation, instead allowing both warning and non-lethal firing to be undertaken. In a convention combat scenario the rules of engagement may include means to discriminate between combatants and non-combatants.

Preferably, the AWS has track processing means to process said acquired images or data to determine the correct pointing angles for the weapon to compensate for platform or target motion. The track processing means may include one or more digital signal processors that obtain information relating to target motion relative to the weapon or its platform from one or more locations within one or more fields of view of each sensor that the target(s) occupy, and/or from the apparent motion over time of the target(s) in such fields of view. The accuracy of the track processing means is preferably enhanced by resolving all motion to a local quasi-inertial reference frame so that the track processing means has access to data from such a frame, either within the AWS or external to it.

The AWS may have correction processing means to determine corrections to the weapon pointing angles to compensate for weapon, ammunition, environmental, target range and/or platform orientation. Preferably, the correction processing means includes a computer or digital processor that computes weapon pointing corrections to allow for munitions drop due to target range and/or other factors. These factors include aiming corrections for temperature, atmospheric pressure, wind, weapon cant, target elevation, ammunition type, weapon age, and factors unrelated to target or weapon platform motion.

Preferably, an aim processing means is provided on the AWS to determine the correct weapon pointing angles based on all factors relating to weapon pointing. The aim processing means may also convert these factors to input control signals. The aim processing means preferably includes a computer or digital processor or a partitioned part thereof. The aim processing means may have knowledge of the position, motion limits and/or characteristics of the weapon mounting system for scaling the input control signals to optimise the weapon mounting system response. Preferably, the input control signals are scaled so that the correct pointing of the weapon is obtained in the shortest possible time.

For simple applications or missions, the processing requirements of the AWS are preferably consolidated into one or more processors. For example, the image processing means, the track processing means, the correction processing means, the aim processing means, and/or the firing control means may not have dedicated processor(s) for each function.

The weapons mounting system preferably includes a two axis motor driven gimbal that supports a weapons cradle. Servo electronics are preferably provided to amplify the input control signals with sufficient gain and band width to maintain stable control of the two axis gimbals under the dynamic force loading of typical engagement scenarios.

The weapon mounting system is preferably configured to interchangeably accept a number of weapons such as the M2, MK19 and M60 machine guns.

The AWS can include a laser range finder which provides an input to the targeting means to more accurately determine the appropriate pointing of weapons, including ballistic weapons. This rangefinder preferably has the capability to measure the range to a specific projectile fired by the weapon as that projectile moves away from the weapon for determining the actual muzzle velocity under the specific circumstances of engagement. This data is important for accurate engagement at longer ranges, and can only be estimated prior to the firing of the weapon. The rangefinder preferably has a receiver which is sensitive to the spatial frequency of the energy reflected by the projectile for determining the direction of the projectile. This information may be required for estimating down-range perturbation forces such as wind.

In one form of the invention th imaging system captures radiation emitted by or reflected from the target. In other forms of the invention th targ t may be irradiated for example with laser light from a source mounted with the weapon, and either the spatial intensity modulation of the reflections, or the reflection spectrum itself, can be used to detect or classify targets.

The threat profile, external cueing, and other target identification criteria may be used to significantly reduce the amount of processing required by the image processing means. For example, the criteria may be selected according to the environment in which the weapon is operated so that it seeks only targets that will be found in that type of environment. Thus in a marine environment the weapon might not consider vehicles or personnel as possible targets but may for example give priority to seeking missiles, aircraft or vessels. Aircraft might be sought only above the horizon, and vessels only below, with missiles sought throughout each sensor field of view.

The invention overcomes deficiencies of prior art by removing the human operator from the closed loop control system that aims and fires the weapon. However, this step is not possible without simultaneously integrating a fail-safe capability to interpret and implement rules of engagement for the weapon.

The AWS provides the following performance features, overcoming difficulties or deficiencies in prior art and implementing additional advantages not accessible by prior art:

Accuracy. The weapon firing is controlled by electronic impulses obtained by processing data from sensors that can accurately determine the position of the weapon aimpoint (e.g. where the barrel of the weapon is aimed) relative to the selected target at any time, and specifically prior to weapon firing. The result is unprecedented accuracy in both single shot and burst modes of firing.

Ergonomics. Since the weapon firing is independent of human intervention, system ergonomics are excellent. The human operator of the weapon acts as a supervisor of the weapon systems, providing high level input such as cueing commands, target prioritising, and s tting rules of engagement. Thes activities are not required to be performed in real-time, so both the gunnery and other operator tasks are enhanced.

Stabilization. The AWS incorporates sensors that can determine the position of the weapon aimpoint relative to the selected target at any time, and with a high frequency of update. Any relative motion, whether due to motion of the target or the weapon, is measured and aimpoint corrects are applied automatically through the weapon drive motors. These corrections can incorporate a full or partial fire control solution, depending on the availability of sensor data.

Surveillance. The enhanced mobility and lethality of the autonomous weapon systems brings about a convergence between surveillance and engagement assets. The traditional separation of these roles is not required, because the sensor array of the AWS can be utilized for traditional surveillance applications, with significant costs savings.

Recording. The weapon system can record the target image at any time, including for each engagement. This has advantages in battle damage assessment as well as providing an audit trail for compliance with rules of engagement. Developments in international law as applied to the use of military force can place the onus of proof of compliance on the gunner. This system clinically implements pre-programmed rules of engagement, and includes strong firing veto powers to the off-line operator as well as an audit trail.

Sensor integration. Because the system operates without human involvement in the closed loop control system, integration of additional sensors, co-located with the weapon or remote from it, is possible. By way of example, acoustic direction-finding sensors do not interface readily with human gunners, but integrate seamlessly with the AWS to provide cueing data for internal sensors.

Peripheral vision. One of the most problematic areas in the development of remote weapon systems has been the difficulty associated with providing the gunner with situation awaren ss comparable to that available to traditional gunners, through the panoramic vision available in the exposed firing position. Multiple wide-field camera systems can capture the required data, but no satisfactory means of presenting this data to a remote gunner has been developed. Multiple screen displays have been unsuccessful, even when integrated into a heads-up display. The AWS according to the invention is intrinsically suited to parallel image processing of multiple frames that cover up to 360 degrees of vision. The image processing and analysis are substantially the same as applied to the frontal field of the weapon system, allowing the system to retain an enhanced level of situation awareness. The system can include sufficient processing power to implement peripheral vision with data provided to both the main sensors and the operator (if present).

Delayed fire mode. The AWS may include a synchronous firing mode that allows for induced oscillations of Fe weapon aiming position to be compensated by delaying the firing of individual shots from the weapon to the exact point of optimum alignment of the aimpoint, allowing for system firing delays.

Expert system. The AWS may include sufficient processing power to implement a learning program that allows the system to progressively improve the interpretations it applies to its operator inputs, as well as engage targets with enhanced effectiveness. The AWS may include a target database that is retained and used by the image processing means to classify targets as well as to select specific soft points on each target to engage if cleared to fire. For example, the sensors on a main battle tank are specifically initially targeted by this system, rather than the tank itself, and the system can learn new sensor configurations and placement for each type of tank.

IFF compatibility. Casualties from friendly fire are a major problem for modem combatants, largely due to the pace of modem combat and reduced reaction times. Autonomous weapon systems potentially exacerbate this problem, if deployed with aggressive rules of engagement. However, the invention includes electronic support for an external IFF (identify friend or foe) firing veto, with virtually instantaneous response. This means that in addition to the applicable rules of engagement and the remote operator firing veto, the weapon can accept a real-time firing veto based on any IFF protocol in use at the time of deployment.

User identification. The AWS may include within its processors the memory capability to store identification data for as many users ass are ever likely to be authorized to use the system. The identification data may include retinal scan, voiceprint, fingerprint, or other biometric data for each authorized modification.

Low power. The AWS may include power-saving features to allow it to be deployed unattended for extended periods using battery power. Lightweight, battery-operated systems can be deployed with specific rules of engagement to deny mobility or terrain access to an enemy without the disadvantages of deploying mines. A wireless link to the weapon operator can be maintained to allow arbitration of weapon firing.

BRIEF DESCRIPTION OF THE DRAWINGS

The accompanying drawings, referred to herein and constituting a part hereof, illustrate preferred embodiments of the invention and, together with the description, serve to explain the principles of the invention, wherein.

Figure 1:
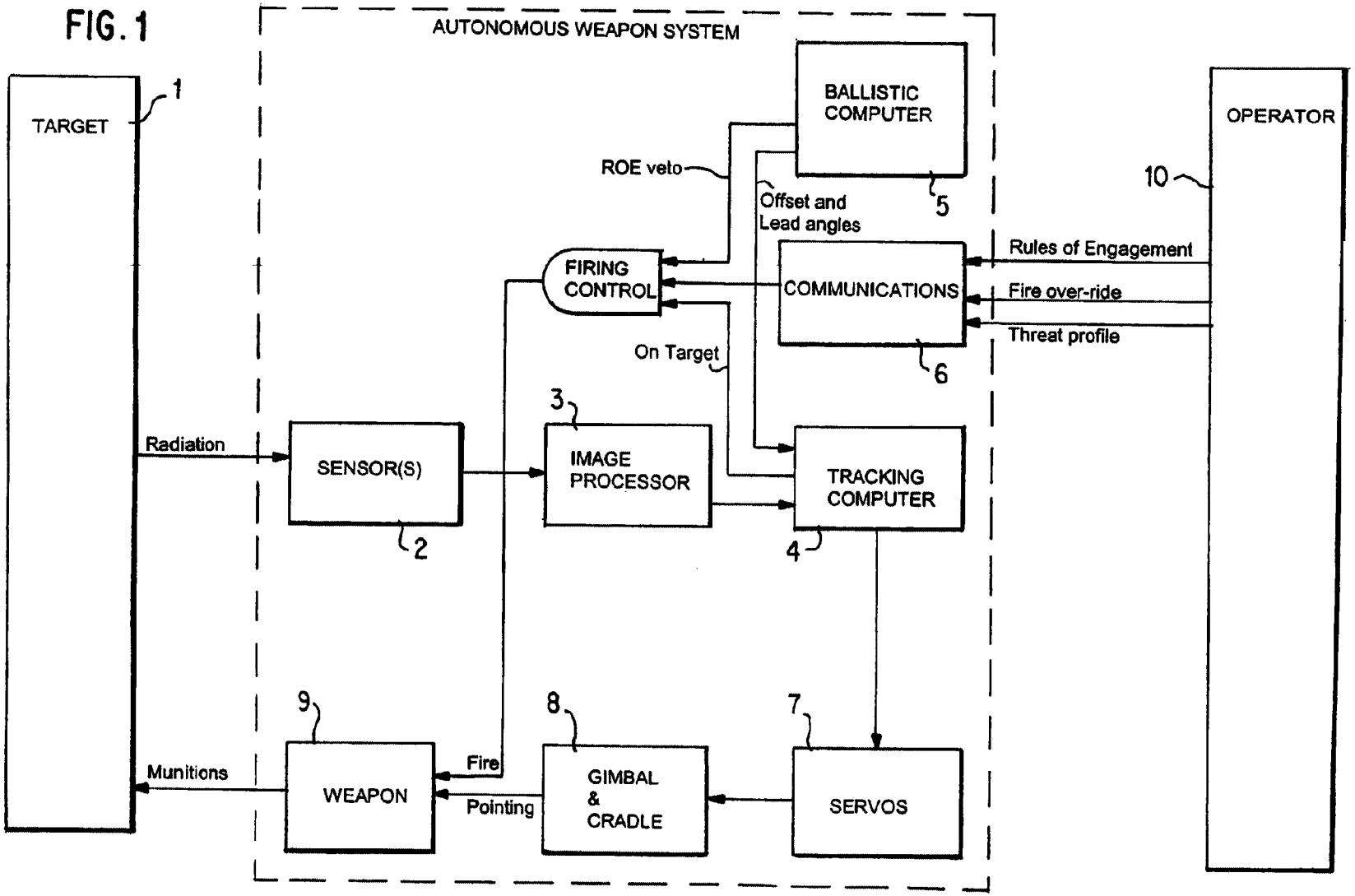
FIG. 1 shows the principal components of the AWS according to the invention, in functional schematic form.
Figure 2:
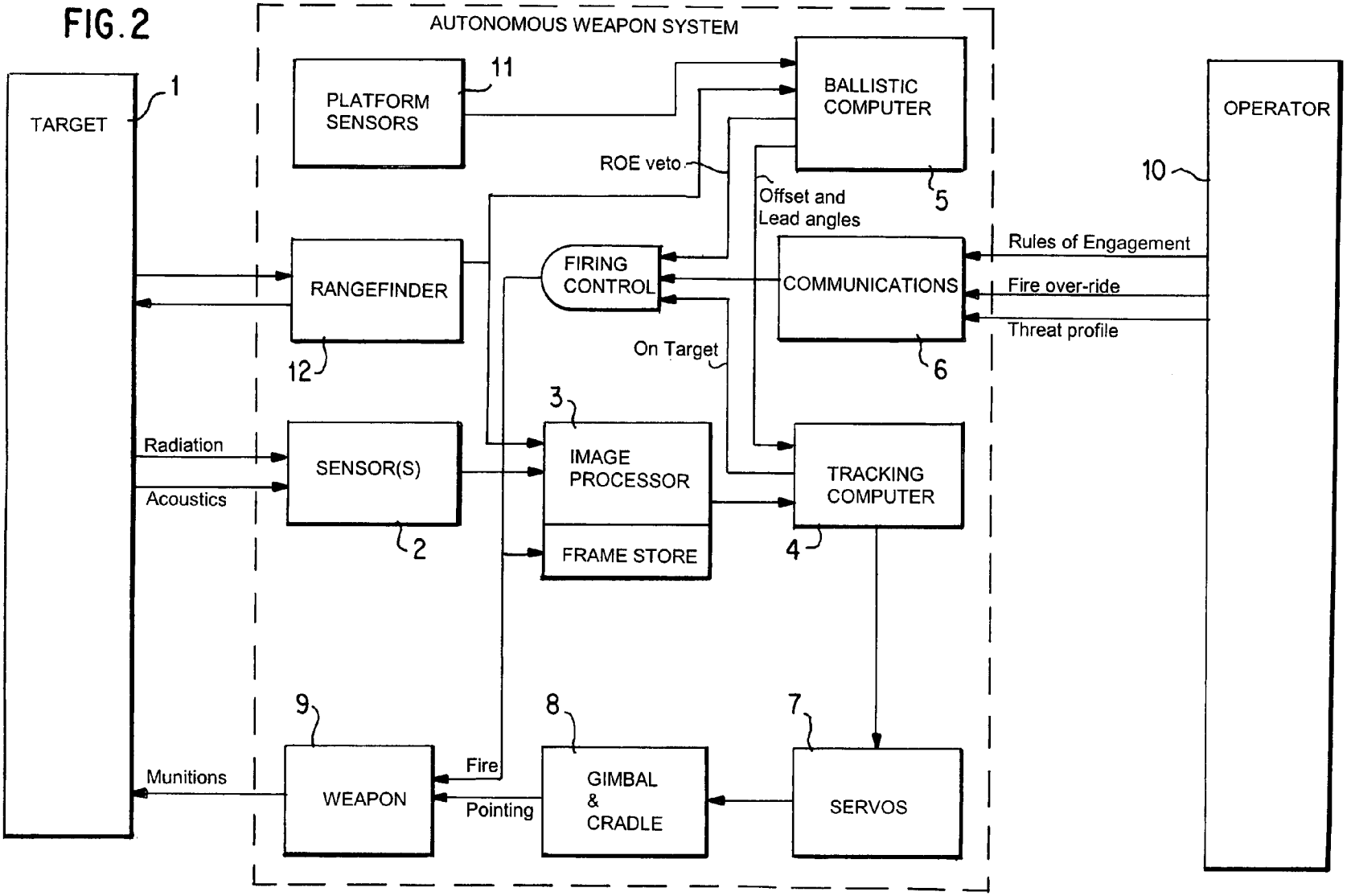
FIG. 2 shows another implementation of the invention, with additional sensors according to the invention, in functional schematic form.
Figure 3A:
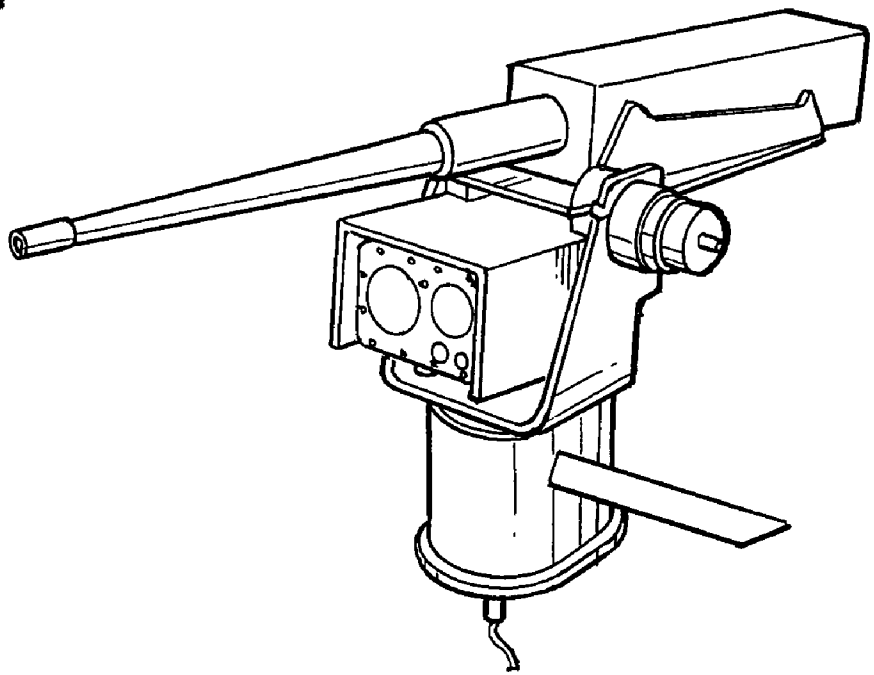
FIG. 3 shows a physical representation of the AWS in a basic implementation for a ballistic weapon system.
Figure 3:
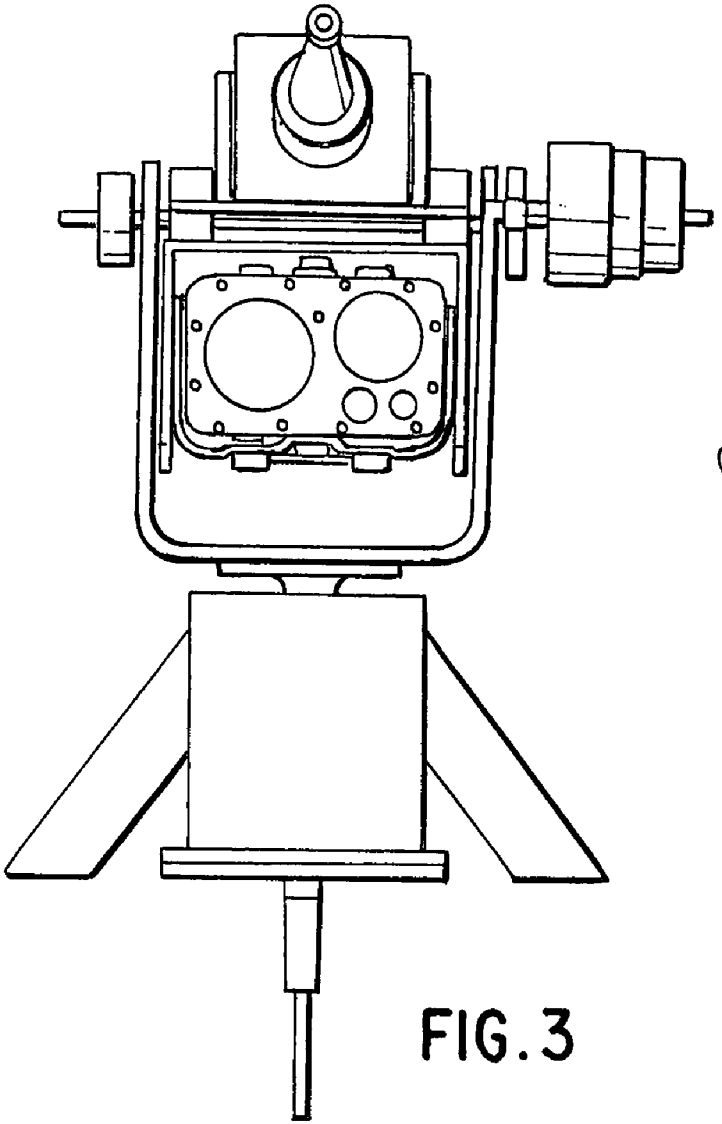
Figure 4A:
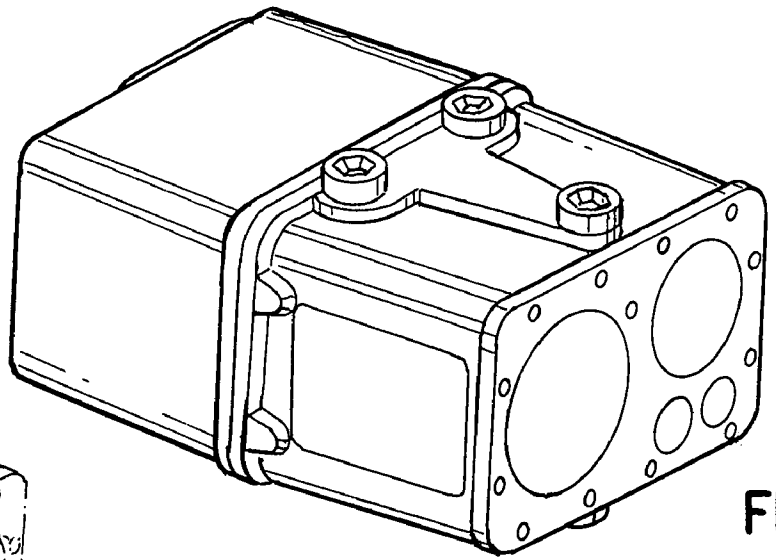
FIG. 4 shows the sensor systems, image processing, tracking computer, ballistic computer, and ancillary electronics packaged as an integrated unit ("Sensor Unit"), and with the case removed to expose key components.
Figure 4:
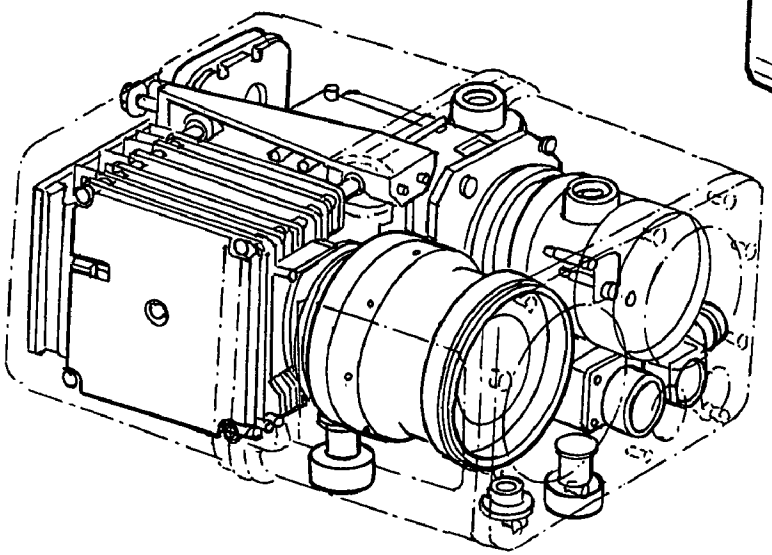

EMBODIMENTS OF THE INVENTION (a) System Overview: AWS

Electro-magnetic energy reflected or radiated by the target [1] is detected by the imaging sensors [2]. Typical imaging sensors include CCD or CMOS cameras, intensified CCD or CMOS cameras, high quantum efficiency CCD or CMOS cameras operating at very low light levels, thermal imaging cameras, and bolometric thermal sensors.

A single imaging sensor is sufficient to provide an image that meets the basic requirements for the AWS to operate. However multiple sensors operating in both visible and infrared spectrums, and with their combined data used to make decisions in respect of target detection, provide improved performance.

The image(s) from the sensor(s) are passed to the image processor [3] where they are digitally enhanced and processed to detect and classify objects of interest.

Once the image processor [3] has detected and classified a target, its position and motion relative to the boresight of the sensor system is determined on the basis of information contained within successive image frames by the tracking computer [4]. If the target is in motion relative to the weapon (ie. if either the target or the weapon is in motion) more than one image frame is required to obtain useful results from the tracking computer.

The tracking computer determines the pointing angle corrections to compensate for present pointing errors, platform motion, and expected target motion.

At the sam tim a target rang estimation is made by the imag processor [3], based on visual clu s within th images, or by means of a laser rangefind r [12]. This rang is provided to the ballistic computer [5] to allow range-dependent weapon lead angle and elevation to be included in the pointing commands provided to the weapon servo system [7].

Additional platform sensors [11] mounted on the weapon platform provide physical and environmental data for higher precision aimpoint determination for ballistic weapons.

The tracking computer combines all pointing angle corrections to obtain a single command (per axis of the weapon gimbal) that is passed to the servo system. The servos [7] amplify the angle commands to provide drive commands for the gimbal drive motors, located on the gimbal [8].

The weapon [9] is fired under the direct control of the ballistic computer [5] which strictly adheres to pre-set rules of engagement, and is subject to a firing veto from the operator via the communications link.

A communications [6] interface allows an operator [10] to provide commands and support for the system. The communications interface may consist of a cable or wireless link.

The AWS provides a closed-loop system commencing with the target radiating or reflecting energy, and ending with the accurate delivery of munitions to the target position. There is no human operator or gunner in the closed-loop process. The operator does have a role in non-real-time processes that enhance the closed-loop response.

(b) Sensor [2]

The sensors include at least one imaging system to allow the weapon to be aimed at the target, or at the correct aimpoint to engage the target having consideration of the munitions, target range, and other aiming factors.

(c) Image Processor [3]

The image processor [3] consists of:

an input buffer memory, made up of multi-port or shared memory, where the output of various sensors is temporarily stored, and where it can be read by the image processor as well as written by the sensors;

a digital signal processor ("DSP") typically operating with a clock speed of 500 MHz, but which can be slowed under program control to conserve power and reduce electromagnetic emissions; and an output buffer memory, where the output image frames are stored in various formats, including summary formats containing only target identification and its position, prior to display or communication or re-entry into the image processor for additional processing.

The digital data from the sensors is normally transferred to the DSP in blocks, representing an image frame for the sensor. Multiple sensors can be synchronized by the image processor such that they operate at the same frame rate, or such that every sensor operates at a frame rate that is a multiple of the slowest frame rate used. This expedites frame integration and data fusion from multiple sensors, because common time boundaries can be used to merge sensor data.

The DSP operates in a processing loop based on the fastest frame rate, and in a sequence that typically uses the following steps:

The data from individual sensors is optimised. Sensor data for each sensor is corrected by the DSP for image distortion, damaged pixel infill, pixel responsiveness variations, and other sensor defects that can be mapped, calibrated or corrected.

Sensor data is enhanced. Typically, contrast enhancement is sought by applying a variety of digital filters to the sensor data. The filters include contrast stretch, chromatic stretch, temporal filtering, spatial filtering, and combinations of these. The filter mix is tuned until an objective imag criteria set indicat th frame has been optimised. In practice, the DSP us s a fixed number of filter combinations, pre-tested for their effectiveness, and filtering can also be applied according to pre-determined filter sets, rather than by inter-active tuning of the filter sets.

The DSP determines whether there is any useful information in the sensor data after enhancement. In many instances the data comprises only noise, and the DSP can conserve power by avoiding further operations.

Image features are tested for similarity with possible targets, which have been ranked according to probability and risk by operator commands. This ranking is referred to as the threat profile, and the DSP has access to a catalogue of standard profiles that can be invoked by the user by reference.

Possible fits of image features with a threat result in user alert, and closer scrutiny of the image features, possibly by means of additional sensors of by zooming a sensor for more detailed examination. Threat classification requires significant system resources, and this step benefits greatly from user intervention, based on image fragments being relayed to the user for comment. Multiple potential targets can be detected and classified in this way An image provided to the tracking computer and the user, if connected. This image may be an enhanced frame from a single sensor, a compound frame arising from fusion of data from more than one sensor, or a numeric sequence that provides the system status, including the target description and its location in the field of view of the sensor.

The effectiveness of the signal processing algorithms employed is substantially enhanced by narrowing the scope of the search algorithms. This is done by one or more of the following:

seeding of the target classification process with a priori knowledge of the scene; or reducing the region within the sensor frame that is processed to some subset of the frame as indicated by a separate cueing system; or restricting the scope of the processing algorithms to a specific class or classes of target such as watercraft, armoured vehicles, personnel, or aircraft; or structuring the search process to use specific spectral imaging bands corresponding to the emission or reflection spectra of typical or expected targets; or restricting the algorithm to operate only on image movement in one or more spectral bands; or any combination of these factors.

The factors used by the image processor are installed by the operator at any time prior to, or even during, an engagement. The image processor frame throughput improves from 0.2 frames per second to over 30 frames per second if sensible use is made of these factors to reduce the scope of the threat detection and classification algorithms.

(d) Tracking Computer [4]

The tracking computer [4] operates on data provided by the image processor [3]. Its function is to:

examine successive frames to determine the current pointing error of the weapon and the likely error over the next short interval (typically 200 milliseconds);

add the ballistic correction angles provided by the ballistic computer; and output the net pointing correction to the servo system.

The tracking computer checks for motion by detecting pattern movement, based on potential targets or features identified by the image processor [3]. A motion algorithm separates whole-frame motion from partial-frame motion. Partial-frame motion is likely to b subsequently classified as target motion, and whole-frame motion is likely to be subsequ ntly classified as weapon motion.

(e) Ballistic Computer [5]

The ballistic computer is also the firing control computer.

The ballistic computer determines a "fire control solution" (conventional terminology) for ballistic weapons to the extent that sensor and other input data is available. The ballistic computer provides this information to the tracking computer [4] in the form of an incomplete solution that is ultimately solved by the tracking computer [4], which provides the last required variables from its real-time analysis of sensor images.

The real-time task of the ballistic computer [5] is to control the firing of the weapon, including ensuring full compliance with the rules of engagement. This function is fail-safe so that the weapon will disarm itself on failure.

The ballistic computer [5] contains a catalogue of rules of engagement, with several scenarios for each mission profile. Typical mission profiles include reconnaissance patrol, infantry support, stationary firing zone, asset protection, sniper suppression, defensive withdrawal, peacekeeping patrol, firing suppression with area fire, interdiction and non-lethal intervention. For each mission there are specific rules of engagement and within each set of rules there are escalating levels of response leading to lethal firing of the weapon.

Every set of engagement rules supports user veto if required by the user. The veto or over-ride can be exercised prior to the engagement by the user selecting levels of response for individual targets before an engagement commences.

The choice of targets and their engagement sequence is made by the ballistic computer, based on the threat level presented by each target, and the rules of engagement.

(f) Communications [6]

The communications [6] between the operator and the weapon system allows the operator to provide commands and support for the system. The operator may, either by reference to standard internally-stored scenarios or directly:

update or alter the operating software for the system;

provide the system with new or amended rules of engagement, or command that a new set of rules from within the weapon system memory be applied;

provide the system with risk profiles or command that a new profile from within the weapon system memory be used to allow processor effort to be allocated and expended in proportion to the risk posed; or provide manual or external cues or sensor readings to improve the effectiveness of the system;

provide target priorities, and/or updates on optimum attack points for specific targets;

request transmission of image, status, or sensor data; or require case-by-case veto over the firing of the weapon.

The communications between operator and AWS can function over very limited bandwidths, but can also make use of video bandwidths, if available, to allow the operator to observe various sensor outputs. The AWS will optimise its communications to suit the available bandwidth to the operator.

Video bandwidths (MHz bandwidth) are available if the operator is located close to the weapon, where cable, optical fibre, or wideband wireless links may be used. In this case, the operator can effectively 'see all that the AWS sensors can "see".

If the communications link has kHz bandwidth, then the system will transmit simple status information, including summary target and status in numeric form, referencing known target types. An image fragment, as required for the operator to xercis a firing veto, requires around 3 seconds of transmission tim on a 8 kbaud communications link. This is operationally viable.

(g) Servos [7]

The servos must provide sufficient power gain, and with sufficient bandwidth, to allow the weapon gimbal to point as commanded despite a wide range of perturbing forces that include weapon shock and recoil, platform vibration (eg. from a vehicle), and wind buffet.

The servos are designed such that the natural frequencies of the weapon gimbal and servo (combined) do not correspond with any predicted excitation of the weapon system, including but not limited to its preferred firing rates.

(h) Gimbal and Cradle [8]

The weapon cradle supports the weapon so that boresight between the weapon and its sensors is retained, to the precision of the weapon and despite the firing shock of typically deployed ballistic weapons, which can exceed 50 g (ie. 50 times the force of gravity).

Depending on the weight limits imposed on the system, and its dynamic performance requirements, the gimbal and cradle can be fabricated from or include metallic or ceramic armour to provide protection to the sensors and electronics of the AWS.

(i) Weapon [9]

The AWS is suitable for deploying all direct fire weapons. The weapons requiring the most complexity in the AWS are ballistic weapons, because they have "dumb" munitions (ie. the aiming of the munition cannot be improved after it has been fired) and they are susceptible to the widest range of environmental parameters. These parameters include weapon characteristics (eg. barrel wear, barrel droop with temperature), ammunition characteristics, atmospheric variables, range target motion, weapon motion, and distance to the target.

Ballistic weapons firing ammunition that requires in-breach fusing are also suitable for deployment on the AWS because the setting of fuses is simplified by the integrated range determination systems.

Close range missiles (eg. TOW, STINGER) have smart munitions with sensors that are effective over a narrow field of view. These weapons achieve optimum efficiency when deployed on AWS, because the weapon arming, uncaging, and firing are supported by electro-optic and other sensors that are more effective in terms of target discrimination and selection than the simplified sensors deployed in the missiles themselves.

Directed energy weapons are simply adapted to the AWS. These weapons require extremely small lead angles, and are independent of gravity and environmental factors, in terms of aimpoint. The AWS automatically discards all ballistic algorithms if deployed with directed energy weapons, at the same time introducing corrections for atmospheric refraction and firing delay (typically 1–2 milliseconds). The atmospheric refraction corrections are required if the weapon wavelength and the sensor wavelength are not similar, and are particularly important for applications where the weapon and the target may be at different atmospheric densities.

(j) Platform Sensors [11]

The AWS uses data if available, from sensors mounted on the weapon platform to determine parameters that influence the aiming of the weapon. These parameters include:

- Temperature, which impacts the droop angle of the barrel and the combustion rate of ballistic propellant;
- Atmospheric pressure, which impacts propellant burn rate (muzzle velocity);
- Weapon cant angle, which rotates the axes of the sensors boresight d to the weapon and must th refore be measured if accurate aimpoint calculations are to be obtained (included in "Inertial reference coordinates", below);
- Target elevation, which requires additional aimpoint adjustment due to the potential (gravitational) energy difference between weapon and target weapon and must therefore be measured if accurate aimpoint calculations are to be obtained (included in "Inertial reference co-ordinates", below);
- Weapon rotation rate (on each axis of potential rotation); which can be otherwise confused with target motion;
- Position (both absolute and relative) as measured by (eg.) GPS, which can be used to enhance AWS sensor cueing by external sensors such as acoustic sensors deployed on known map grid positions; and
- Inertial reference co-ordinates, that may be used to resolve the direction of gravity under all conditions, allowing accurate calculation in real time of the forces applying to ballistic munitions.

In practice, an inertial reference system is highly desirable if the weapon platform is mobile or maneuverable, whereas the measurement of cant and target elevation may be sufficient for slowly moving or stationary weapon platforms.

(k) Rangefinder

The formulation of an adequate ballistic solution for any target beyond about 500 m in range depends on the accurate determination of the range to the target.

Although the AWS can determine the target range approximately by using the pixel scale of the image, this may not be adequate for all applications.

A laser rangefinder is commonly included in the AWS configuration to provide an accurate determination of the range to the target.

The AWS uses weapon type, ammunition type, and meteorological parameters to predict the muzzle velocity for ballistic weapons. The weapon aimpoint is very strongly dependent on munition muzzle velocity, and it is advantageous if this is obtained by measurement rather than inferred indirectly. For most ballistic munitions, two laser range measurements made approximately one half-second apart and after the munition has left the weapon barrel will allow a very accurate estimation of muzzle velocity. The AWS laser rangefinder can measure range in 2 Hz bursts to provide accurate muzzle velocity measurements.

The fall of ballistic munitions can be determined with high accuracy if all significant environmental parameters are known. In practice the most difficult parameters to estimate are the transverse and longitudinal forces (eg. wind) along the munition flight path to the target. The AWS laser rangefinder includes a gated imaging system that is sensitive at one of the emission lines of the AWS laser.

Using the firing epoch of the munition and its known muzzle velocity, the munition is illuminated by the AWS laser before it reaches the target range. An imaging system that is sensitive to the laser wavelength is gated in time to show an image that includes laser light reflected by the munition. The transverse location of the munition image allows the integrated transverse forces applying to the munition along the flight path to be determined.

By this means, the aiming point of the weapon can be corrected even before the first round has approached the target.

(l) Operator [10]

The operator [10] is the AWS supervisor and mentor. As described above, the communications link between the system and the operator may vary in bandwidth from zero to several MHz. The type of communication between operator and system will depend on the nature of the communication link, and the tactical situation.

Typical scenarios are:

- The AWS is deployed on a vehicle with the operator conveyed in the vehicle. In this case the data link is a simple RF cable connected to the operator's visor display, or an equivalent intra-vehicle wireless link. Operator input is by voice, motion (including eye motion), or manual entry. To the extent that he is able, the operator provides cues to the image processor and the tracking processor to expedite threat classification, prioritising and tracking. The operator also can control the target engagement sequence and rules of engagement for each target. Rules of engagement can be suspended for small angular sectors for short intervals, in target-rich environments.
- AWS deployed unattended. The unattended AWS will normally default to low-power surveillance mode, where it continually monitors the zone of terrain allocated to it. This may be done using a single cueing sensor such as a thermal imager or acoustic sensor. Detection of a target progressively brings weapon system sensors on line, until the target is classified into an appropriate category. At this stage the operator may be alerted, with data that may comprise a full or partial image frame, or simply a numeric identification of the status of the system and the number and type of targets. The target(s) will be engaged according to the rules of engagement applying.

The field of view of the sensors must be sufficient to allow the target to be viewed at the same time as the aimpoint is set to the correct position to engage the target. In practice this stipulates that the weapon elevation angle required for the munition to reach the target must be less than the vertical field of view of the sensor used for engagement. Similarly, it stipulates that the lead angle required by the transverse motion of the target is less than the horizontal field of view of the sensor used for engagement.

The reference to any prior art in this specification is not, and should not be taken as, an acknowledgement or any form or suggestion that that prior art forms part of the common general knowledge in Australia.

It is understood that various modifications, alterations, variations and additions to the constructions and arrangements of the embodiments described in the specification are considered as falling within the ambit and scope of the present invention.

The invention claimed is:

1. An autonomous weapon system that can engage targets without human intervention at a time of engagement, said system comprising:

a weapon to be fired at a target;

a weapon mounting system operable to point the weapon in accordance with input control signals;

a sensor system to acquire image data from a target zone;

image processing means to process said acquired image data and identify potential targets according to predetermined target identification criteria;

targeting means to provide said input control signals to said weapon mounting system to point the weapon for firing at a selected one or more of said potential targets; and autonomous firing control means to operate said targeting means and fire the weapon at said selected potential targets, or to preclude or limit such firing, according to a predetermined set of rules of engagement stored in said system.

2. An autonomous weapon system as claimed in claim 1 further including communication means to provide for transmission of data between the weapon system and a remote control location.

3. An autonomous weapon system as claimed in claim 2 wherein said communication means provide for the overriding of the firing control means from said remote control location to prevent firing of the weapon.

4. An autonomous weapon system as claimed in claim 2, wherein said communication means provide for amendment of the rules of engagement from said remote control location.

5. An autonomous weapon system as claimed in claim 1, wherein said firing control means autonomously interprets said rules of engagement according to a threat profile of target identifying criteria.

6. An autonomous weapon system as claimed in claim 1, wherein said sensor system includes one or more cameras operating at the visible, intensified visible or infrared wavelengths producing images compatible with digital processing.

7. An autonomous weapon system as claimed in claim 1, wherein said image processing means includes pre-configured threat profiles to seek targets according to the level of threat posed by specific targets, or the probability of encountering a specific target, or both.

8. An autonomous weapon system as claimed in claim 1, wherein said targeting means provides the input control signals based on pointing corrections required for the weapon to hit the target.

9. An autonomous weapon system as claimed in claim 1, wherein said firing control means includes a fail-safe autonomous control of the firing of the weapon by reference to specific rules of engagement stored within the system.

10. An autonomous weapon system as claimed in claim 1, wherein said rules of engagement include at least one of combat, peacekeeping, or policing scenarios.

11. An autonomous weapon system as claimed in claim 10 wherein said rules of engagement include provision for an enduring veto on selected modes of operation of the weapon.

12. An autonomous weapon system as claimed in claim 1, further comprising track processing means to process said acquired images or data to determine the correct pointing angles for the weapon to compensate for platform or target motion.

13. An autonomous weapon system as claimed in claim 12 wherein the track processing means resolves all motion to a local quasi-inertial reference frame so that the track processing means has access to data from such a frame.

14. An autonomous weapon system as claimed in claim 1, further comprising a laser range finder which provides an input to the targeting means to determine the appropriate pointing of weapons.

15. An autonomous weapon system as claimed in claim 14 wherein the rangefinder measures the range to a specific projectile fired by the weapon as that projectile moves away from the weapon for determining the actual muzzle velocity under the specific circumstances of engagement.

16. An autonomous weapon system as claimed in claim 14, wherein the rangefinder has a receiver which is sensitive to the spatial frequency of the energy reflected by the projectile for determining the direction of the projectile.

17. An autonomous weapon control system for controlling a weapon to be fired at a target using a weapon mounting system operable to point the weapon in accordance with input control signals, said weapon control system comprising:

a sensor system which acquires image data from a target zone;

image processing means for processing said acquired image data and identifying potential targets according to predetermined target identification criteria;

targeting means for providing said input control signals to said weapon mounting system to point the weapon for firing at a selected one or more of said potential targets; and autonomous firing control means for automatically selecting targets from among said potential targets, and for causing said weapon to fire, or not to fire, at said selected targets, or for limiting such firing, according to a predetermined set of rules of engagement stored in said system.

18. An autonomous weapon control system, comprising:

a weapon to be fired at a target;

a weapon mounting system operable to point the weapon in accordance with input control signals;

a sensor system which acquires image data from a target zone;

image processing means for processing said acquired image data and identifying potential targets according to predetermined target identification criteria;

targeting means for providing said input control signals to said weapon mounting system to point the weapon for firing at a selected one or more of said potential targets; and autonomous firing control means for automatically selecting targets from among said potential targets, and for causing said weapon to fire, or not to fire, at said selected targets, or for limiting such firing, according to a predetermined set of rules of engagement stored in said system.

* * * * *